US008611732B2

(12) United States Patent
DeMichael et al.

(10) Patent No.: US 8,611,732 B2
(45) Date of Patent: Dec. 17, 2013

(54) LOCAL HEAT TREATMENT OF IBR BLADE USING INFRARED HEATING

(75) Inventors: Thomas DeMichael, Stafford Springs, CT (US); James J. Moor, New Hartford, CT (US); Herbert A. Chin, Portland, CT (US); Wangen Lin, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 167 days.

(21) Appl. No.: 13/184,733

(22) Filed: Jul. 18, 2011

(65) Prior Publication Data

US 2013/0022339 A1 Jan. 24, 2013

(51) Int. Cl.

| | |
|---|---|
| ***B21D 53/78*** | (2006.01) |
| ***F27B 5/14*** | (2006.01) |
| ***F27D 7/06*** | (2006.01) |
| ***F27D 11/02*** | (2006.01) |

(52) U.S. Cl.
USPC ..... 392/419; 392/420; 392/423; 392/424; 29/889.7

(58) Field of Classification Search
None
See application file for complete search history.

(56) References Cited

U.S. PATENT DOCUMENTS

| | | | | |
|---|---|---|---|---|
| 3,264,472 | A | 8/1966 | Simmons | |
| 3,654,471 | A * | 4/1972 | Nilsson | 250/505.1 |
| 6,242,717 | B1 * | 6/2001 | Sanderson | 392/424 |
| 7,595,464 | B2 * | 9/2009 | Konishi | 219/216 |
| 7,775,690 | B2 * | 8/2010 | Wakalopulos | 250/492.1 |
| 8,437,628 | B1 * | 5/2013 | Lin et al. | 392/419 |
| 2006/0022154 | A1 * | 2/2006 | Schmitkons et al. | 250/495.1 |
| 2007/0047932 | A1 * | 3/2007 | Caldwell et al. | 392/419 |
| 2009/0020523 | A1 * | 1/2009 | DeMichael et al. | 219/553 |

FOREIGN PATENT DOCUMENTS

| | | | |
|---|---|---|---|
| DE | 10055877 | C1 * | 5/2002 |
| EP | 1256635 | A1 | 11/2002 |
| EP | 2019149 | A1 | 1/2009 |
| EP | 2520762 | A1 | 11/2012 |
| JP | 61067719 | A | 4/1986 |
| JP | 2007229729 | A * | 9/2007 |

OTHER PUBLICATIONS

JP-2007229729 A, Nishihara, Sep. 2007, partial translation.*
DE-10055877 C1, Germanflux, May 2002, partial translation.*
European Search Report, mailed Nov. 22, 2012.

* cited by examiner

*Primary Examiner* — Joseph M Pelham
(74) *Attorney, Agent, or Firm* — Kinney & Lange, P.A.

(57) ABSTRACT

A device and method for locally heat treating at least one airfoil in an integrally bladed rotor device. A pair of IR heat sources are positioned to direct IR heat rays in the direction where local heat treatment is required. A pair of parabolic mirrors are positioned to direct the IR heat rays on to the metal component. The heat treating is useful after welding the airfoil on to the rotor device.

3 Claims, 3 Drawing Sheets

LOCAL HEAT TREATMENT OF IBR BLADE USING INFRARED HEATING

BACKGROUND

The manufacture, service and/or repair of metal components, such as gas turbine engines, often times require localized heating of specific areas of the components. This is done, for example, to allow for stress relief, metal forming and/or brazing applications. Localized heating is preferred when processing the entire component could adversely affect the metallurgical properties of the component. Warping and other forms of deformation are also to be avoided.

Integrally bladed rotors are used in some gas turbine engines and are expected to be used even more as engine designs continue to evolve. Upon original manufacture, all integrally bladed rotor material is heat treated to obtain the desired mechanical properties prior to finish dimension machining.

During blade repair operations, it may be necessary to locally heat treat the repaired areas of the integrally bladed rotors that have been exposed to elevated temperatures. In the finished machine condition, conventional heat treatment is not always possible due to concerns with distortion. Additionally, conventional heat treatment of a finished machined integrally bladed rotor may create unnecessary risk due to the potential for surface contamination throughout the entire part. Because of these concerns, local heat treatment has been considered to be a desirable option.

SUMMARY

The present invention comprises the use of focused infrared heat lamps to locally heat treat and/or stress relieve portions of integrally bladed rotors without adversely impacting other critical areas of the integrally bladed rotors. This is done by the use of infrared heat sources on the individual integral blades in an inert environment which in one form uses parabolic minors to focus heat only onto the desired area. A fixture is provided that locates the device at the precise location where heat is to be applied to a localized area, such as after a replacement blade has been attached by welding to a rotor. The present invention may also be used in the initial manufacture of integrally bladed rotors to locally heat treat areas after details have been attached to the rotor, such as by welding or to locally create alternate material properties.

DETAILED DESCRIPTION

Device 10 is positioned proximate an integrally bladed rotor (IBR) airfoil 11 for heating a portion of the IBR airfoil 11 and thereby eliminate overall part exposure to heat. Device 10 includes a pair of infrared (IR) lamp housings 13 and 15, each with an IR lamp generating IR rays that are reflected off parabolic minors 17 and 19, respectively, to contact IBR 11 and heat treat that blade without exposing any other part of IBR airfoil 11 to unwanted heat.

Figure 1:
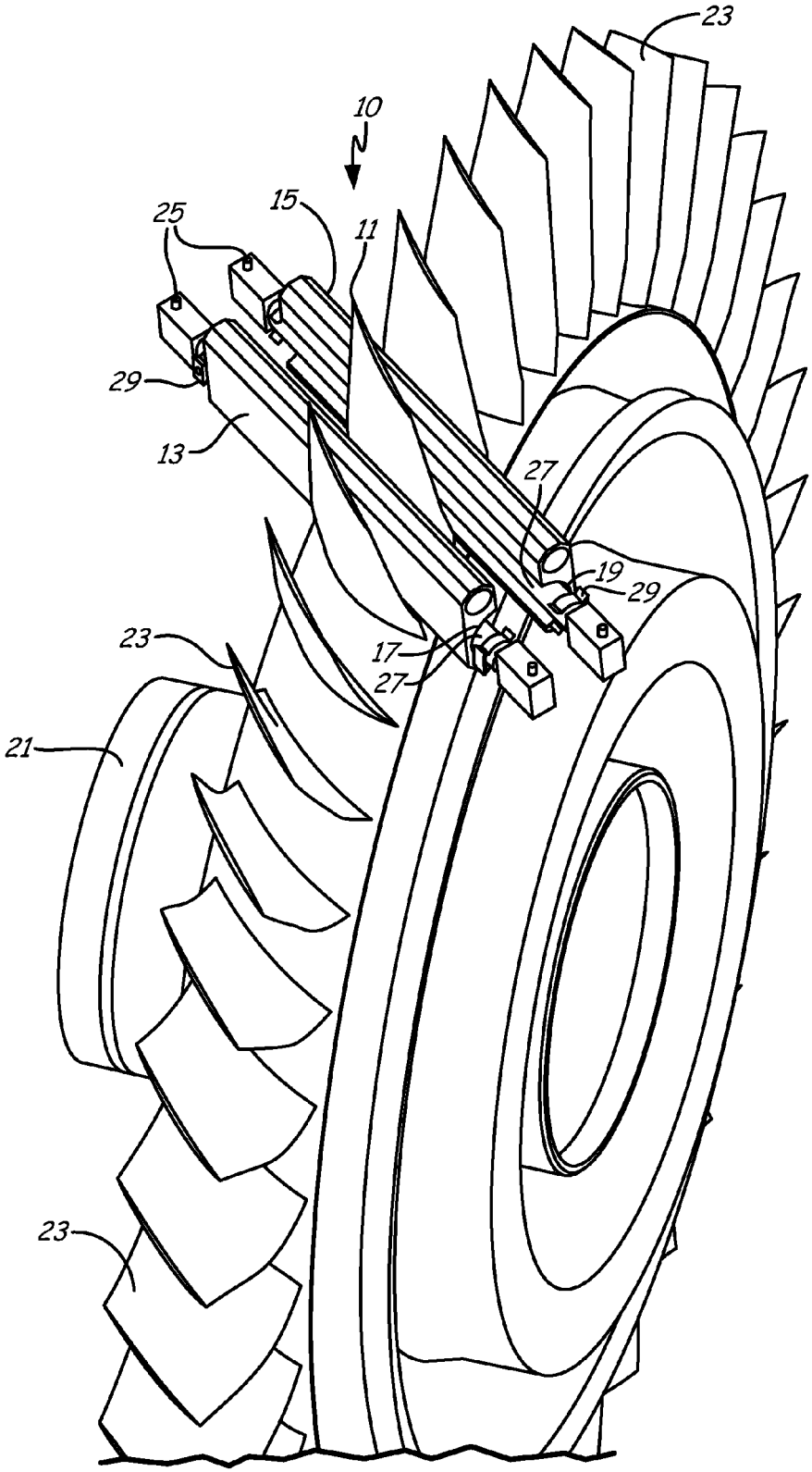
FIG. 1 is a perspective view showing the device of this invention.
Figure 2:
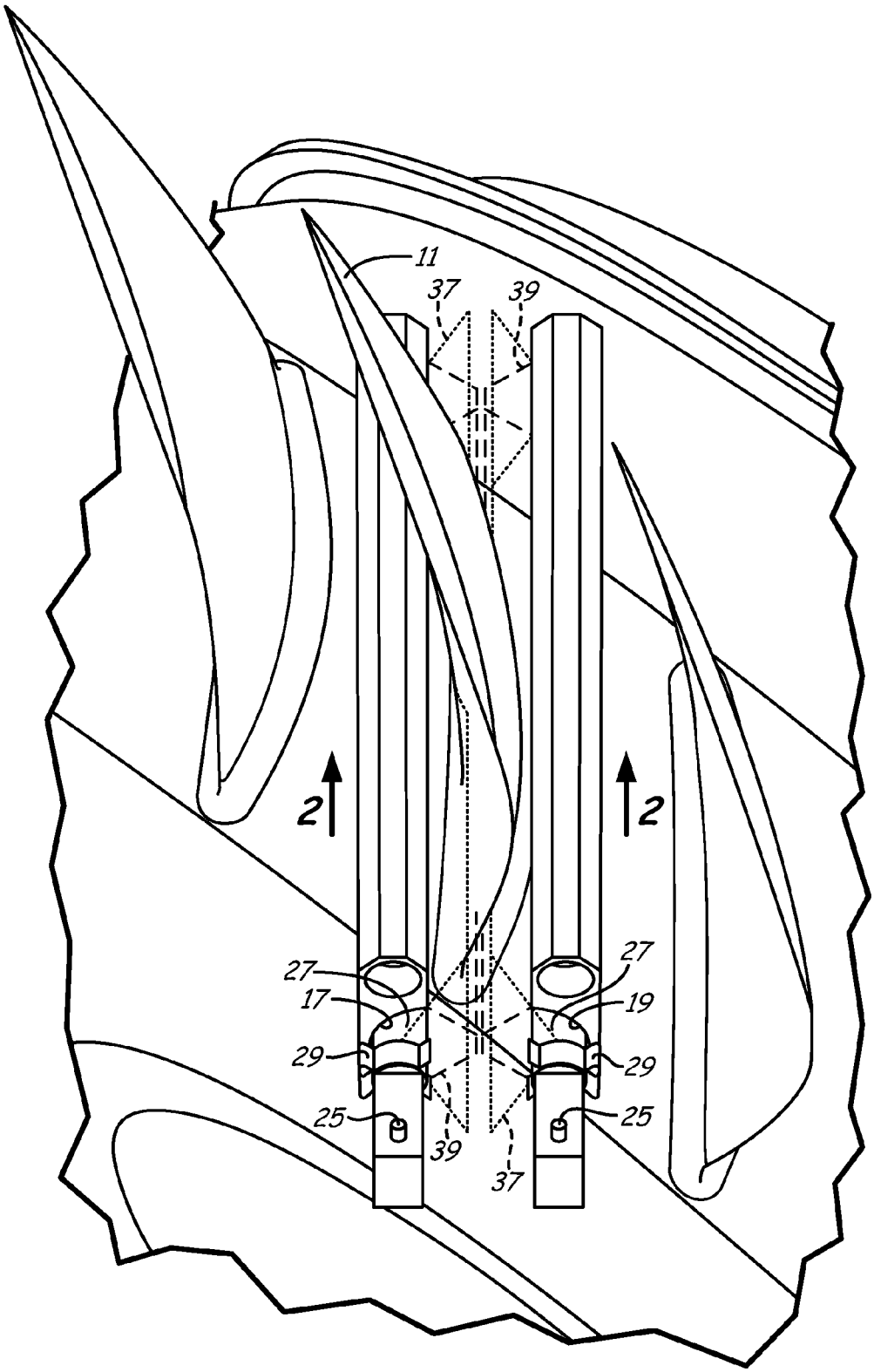
FIG. 2 is a plan view showing the device of this invention focused on a single integrally bladed rotor.

FIG. 1 illustrates a complete integrally bladed rotor with rotor hub 21 supporting a plurality of other airfoils 23. Device

10 is positioned on airfoil 11 and includes electrical contacts 25 connected to a power source, not shown, for actuation of IR lamps 27 that are held in place by clips 29. Rays from IR lamps 27 are focused by minors 17 and 19 as an elongated band of IR radiation on a specific portion of airfoil 11, in this instance the portion of airfoil 11 attached to rotor hub 21. The width of the band of focused IR radiation may be any width that permits complete heat treatment of the desired portions of the component. Band widths may range from about 6 mm to about 18 mm, and may be about a 12 mm band width. Other widths may also be accommodated depending on, for example, the size of the parts, the material being heat treated Device 10 also includes tubes or passages 33, shown more clearly in FIG. 3, that are connected to a source of water or other cooling medium, not shown, to cool portions of device 10 to prevent distortion and a resulting uneven heating. Other cooling devices such as fans and refrigerants may also be used.

Figure 3:
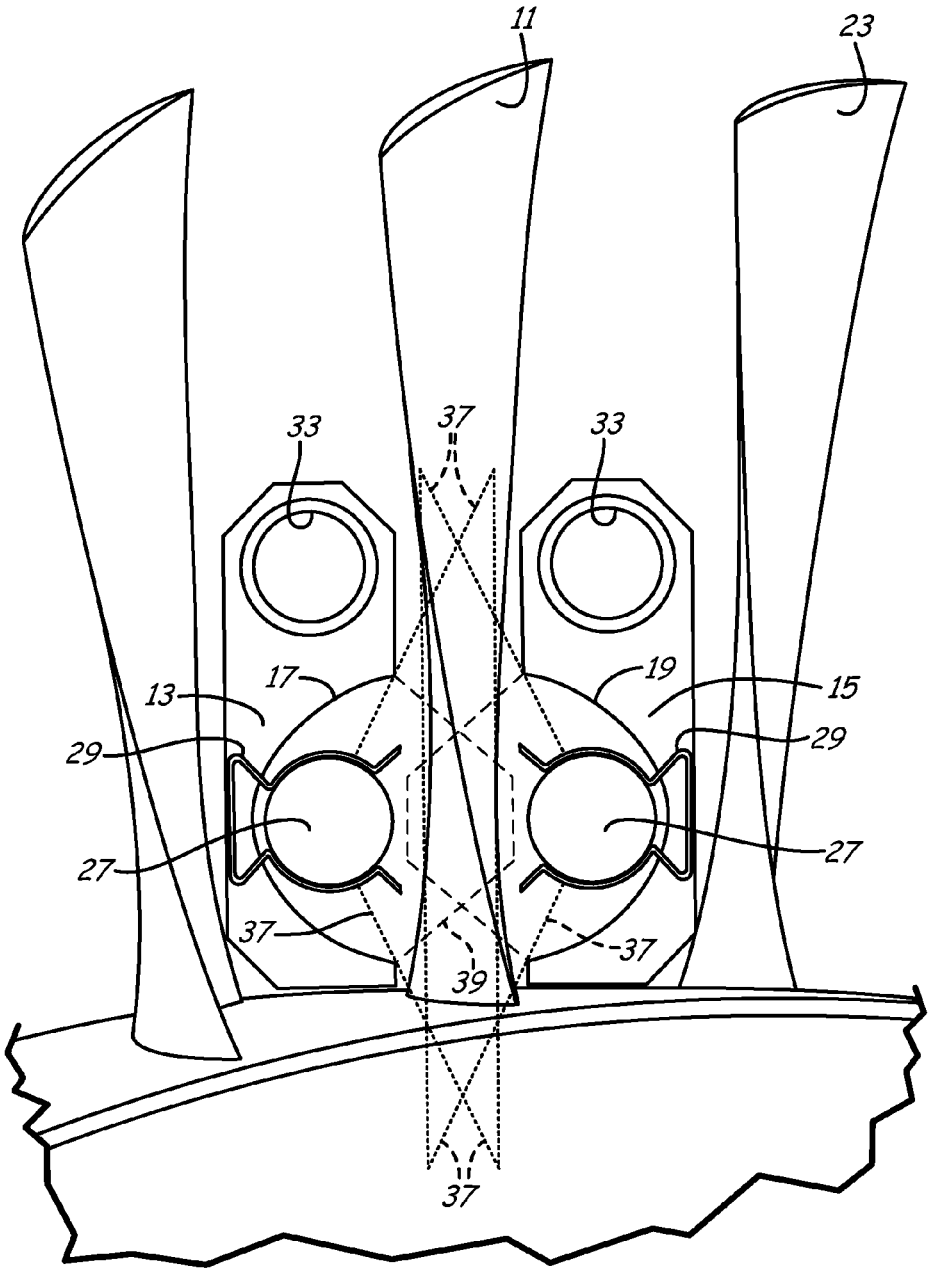
FIG. 3 is a section view taken along line 2-2 of FIG. 2.

Also shown in FIG. 3 are dotted lines 37 that represent the extent of unfocused IR rays from lamps 27, and dashed lines 39 represent the extent of IR rays focused by minors 17 and 19 onto the portion of airfoil 11 that is to be heat treated, such as to relieve stress in the metal after welding airfoil 11 to rotor hub 21.

It is known that heat treatment in the presence of oxygen can cause titanium alloys to become embrittled if the temperature exceeds 1,000° F. (538° C.). In addition to embrittlement, the material properties of titanium alloys changes if it is exposed to a temperature exceeding 800° F. (427° C.), but as will be understood the actual temperature depends on the specific alloy. Oxygen contamination at referenced temperatures can be avoided by proper protection such as the use of inert shielding gas. The present invention ensures that the portion(s) of the product being treated will receive desired thermal treatment but generally remain below 1,000° F. (538° C.) and even below 800° F. (427° C.).

The present invention was used to heat treat and stress relieve a plurality of IBR blades without adversely heating other critical areas of the IBR. In addition, replacement blades have been attached to an IBR by focusing the heat only at the desired location, e.g., where the replacement blade is attached to the IBR. A complete blade replacement for an IBR using the present invention produced no stress or distortion on the rest of the assembly. The device of this invention is suitable for OEM manufacture and for repair of existing IBR systems.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method for heat treating at least one airfoil in an integrally bladed rotor device having a rotor and a plurality of blades, comprising:

providing a pair of housings each having an axially extending cavity, the cavity including a surface forming a parabolic mirror;

positioning an IR heat sources proximate each parabolic minor, wherein the IR heat sources are facing in opposite directions and each IR heat source is aligned with its parabolic mirror to direct IR heat rays in a direction radially inward to the airfoil where it is joined to the integrally bladed rotor device; and cooling each IR heat source to maintain a desired temperature for the IR heat source, the cooling element being part of the housing and having an axial passage adapted to transfer cooling liquid through the passage.

2. The method of claim 1, wherein the IR heat rays are focused into an elongated band having a band width of from about 6 mm to about 18 mm.

3. The method of claim 1, wherein the heat rays heat the metal component to a temperature of at least 1,300° F. (704° C.) and the cooling element maintains the adjacent areas adjacent areas of the metal component below 1,000° F. (538° C.).

* * * * *

UNITED STATES PATENT AND TRADEMARK OFFICE

CERTIFICATE OF CORRECTION

PATENT NO. : 8,611,732 B2
APPLICATION NO. : 13/184733
DATED : December 17, 2013
INVENTOR(S) : Thomas DeMichael et al.

It is certified that error appears in the above-identified patent and that said Letters Patent is hereby corrected as shown below:

In the Specifications:

Col. 1, Line 39
Delete "minors"
Insert --mirrors--

Col. 1, Line 63
Delete "minors"
Insert --mirrors--

Col. 2, Line 4
Delete "minors"
Insert --mirrors--

In the Claims:

Col. 2, Line 66
Delete "minor"
Insert --mirror--

Signed and Sealed this
Twenty-second Day of April, 2014

Michelle K. Lee

Michelle K. Lee
*Deputy Director of the United States Patent and Trademark Office*